US005501771A

United States Patent [19]

Bourson

[11] Patent Number: 5,501,771

[45] Date of Patent: Mar. 26, 1996

[54] PAPERMAKING PROCESS AND PAPER PRODUCED THEREFROM

[75] Inventor: Lucien Bourson, Colombes, France

[73] Assignee: Elf Atochem S.A., Puteaux, France

[21] Appl. No.: 234,632

[22] Filed: Apr. 28, 1994

Related U.S. Application Data

[63] Continuation of Ser. No. 912,730, Jul. 13, 1992.

[30] Foreign Application Priority Data

Jul. 12, 1991 [FR] France ..... 91 08819

[51] Int. Cl.[6] ..... D21H 17/00

[52] U.S. Cl. ..... 162/158; 162/164.3; 162/164.6; 162/168.2; 162/175; 162/177; 162/179; 162/181.2; 162/181.3; 162/181.4; 162/181.5; 162/183

[58] Field of Search ..... 162/175, 183, 162/181.2, 181.3, 181.4, 181.5, 179, 158, 168.3, 168.2, 181.6, 164.3, 164.6, 177

[56] References Cited

FOREIGN PATENT DOCUMENTS

| | | | |
|---|---|---|---|
| 34970/89 | 11/1989 | Australia | 162/181.6 |
| 257772 | 3/1988 | European Pat. Off. | 162/175 |
| 285486 | 10/1988 | European Pat. Off. | 162/168.3 |
| 285487 | 10/1988 | European Pat. Off. | 162/175 |

*Primary Examiner*—Peter Chin
*Attorney, Agent, or Firm*—Burns, Doane, Swecker & Mathis

[57] ABSTRACT

Homogeneous and regular paper sheets are shaped, via conventional papermaking technique, from nonpolluting papermaking compositions comprising an aqueous suspension of cellulosic papermaking fibers that also include (a) an inorganic filler material, (b) a papersizing agent and (c) a ternary retention additive which comprises (c)(1) a cationic starch, (c)(2) a polyaluminum chloride and (c)(3) an anionic silica.

4 Claims, No Drawings

PAPERMAKING PROCESS AND PAPER PRODUCED THEREFROM

This application is a continuation of application Ser. No. 07/912,730, filed Jul. 13, 1992.

BACKGROUND OF THE INVENTION

1. Field of the Invention:

The present invention relates to an improved papermaking technique and to the final product paper sheet material provided thereby.

2. Description of the Prior Art:

In conventional papermaking processes, raw paper pulp essentially consisting of cellulosic fibers is formulated into a dilute aqueous suspension which is introduced into the headbox of the papermaking machine from whence it is distributed over a filtering surface, e.g., Fourdrinier wire, on which the web of paper forms. The web is then drained and dried. The quality and properties of the resulting paper are determined, notably, by the operating conditions of the papermaking machine, the state of the raw pulp, the various additives that are added to the suspension prior to the formation of the web, as well as the materials that are deposited onto the paper web downstream of the filter surface.

Among such additives that are formulated into the fiber suspension introduced into the headbox, exemplary are mineral fillers, sizing agents, agents for enhancing the mechanical characteristics of the paper, coloring agents, and the like. The mineral fillers, such as $CaCO_3$, $TiO_2$, etc., render the sheet of paper opaque, thus facilitating writing and printing. Sizing agents, such as the alkylketene dimers, are added to impart liquid resistance properties to the sheet, and to permit the sized sheet of paper to be employed for writing and printing.

One of the qualities of paper, paperboard and other such products is the regularity of its characteristics. Among these is the so-called "look-thru" or "sheet formation" which is extremely important and is representative of the general quality of the paper. The look-thru effectively represents a greater or lesser degree of homogeneity of fiber distribution over the surface and thickness of the sheet. The look-thru quality will hence have considerable influence on the general quality of the print in the case, for example, of paper used for printing and writing, and on mechanical properties in the case, for example, of paper used for packaging. In order to improve the look-thru, more and more additives are being added to the suspension introduced into the headbox. But, in order to meet the increasing strictness of pollution standards requirements, papermaking plants are attempting to decrease their water consumption, which results in an increase in the pollutant loading associated with this type of industry (suspended matter, biological oxygen requirement, chemical oxygen requirement, salinity, etc.). Other problems are also encountered, such as the problem of pitches, rosins and the like, and, more generally, pollutants associated with the presence of so-called anionic trash. As the characteristics of the paper must, however, remain identical and the problems associated with preserving the environment have to be overcome, one of the solutions proposed in the prior art entails increasing retention of the above elements within the web during formation thereof on the filtering surface. This result is attained to a certain degree, by adding retention agents to the fiber suspension introduced into the headbox. Unfortunately, this technique is subject either to variations in its effectiveness, or results in a significant deterioration in the look-thru of the paper, depending on the products used.

Thus, serious need continues to exist in this art for an improved technique for producing paper and the like, in which, in addition to the mineral filler and the sizing agent, unique retention systems are admixed with the fiber suspension or composition introduced into the headbox.

EP-A-348,366 describes a ternary such system comprising cationic starch, a polyaluminum compound, and a silicic acid polymer. No anionic silica is indicated and, in addition, the polysilicic acid must have a given specific surface area (>1,050 $M^2/g$).

WO 88/6,659 describes a ternary system comprising a cationic polymer, polyaluminum compound, and silica. The cationic polymer is preferably polyacrylamide and cationic starch is again not indicated.

EP-A-285,486 describes a retention system based on cationic starch and polyaluminum chloride. The mineral filler can, for example, be silica.

U.S. Pat. No. 4,643,801 describes a retention system based on cationic starch, a high molecular weight anionic polymer and silica, in parts by weight of starch/silica of 100/1 to 1/1 and of anionic polymer/silica from 20/1 to 1/10. An aluminum compound can also be added.

In "polyaluminum hydroxychloride application on neutral pH rosin sizing of paper" by B. H. Wortley and J. C. Steelhammer, a retention system is indicated comprising cationic starch, bentonite and an anionic polymer, but not polyaluminum chloride (PAC).

SUMMARY OF THE INVENTION

Accordingly, a major object of the present invention is the provision of an improved papermaking process, comprising incorporating into the aqueous suspension of papermaking fibers introduced into the headbox of a conventional papermaking machine, in addition to the inorganic filler material and the sizing agent(s), a certain unique ternary retention system.

Another object of this invention is the provision of high retention rates in a papermaking process, as well as an improved dewatering of paper, while maintaining the look-thru quality and other characteristics thereof. The present invention thus permits a greater amount of filler to be employed, notably fillers that are sensitive to acids, providing wastes and effluents that are less polluting.

Briefly, the present invention features an improved method for manufacturing paper which comprises incorporating into the fibrous composition introduced into the headbox:

(a) an inorganic filler material, (b) a sizing agent, and (c) a retention system comprised of:

(c)(1) a cationic starch, (c)(2) a polyaluminum chloride, and (c)(3) a silica anionic in nature.

DETAILED DESCRIPTION OF THE PREFERRED EMBODIMENTS OF THE INVENTION

More particularly according to the present invention, the suspension containing the cellulosic fibers can be crude or bleached pulp, bleached chemical pulp of resinous, foliaceous, or annual vegetable matter, natural unbleached chemical pulps of resinous or foliaceous origin, bleached or unbleached mechanical pulps (SGW, TMP, CTMP, etc.), bleached or unbleached de-inked pulps, pulps that already contain additives, and mixtures thereof.

The cationic starch, indicated as component (c)(1), of the present invention comprises one or more products marketed under the generic name of cationic starch. The starch advantageously has an average molecular weight of $2.10^4$ to $2.10^5$ preferably from $3.10^4$ to $12.10^4$. The cationic starches have an exemplary degree of substitution (D.S.) ranging from 0.01 to 0.1. The cationic starches include, for example, those described in Kirk-Othmen, *Encyclopedia of Chemical Technology,* 3rd edition, volume 21, page 503. Preferably, they constitute, by weight, from 0.2% to 1.7% of the weight of the fibrous suspension introduced into the headbox.

The polyaluminum chloride (PAC), indicated as component (c)(2) according to the present invention, comprehends products that are typically designated aluminum polychloride, basic polychloride of aluminum, basic polychlorosulfate of aluminum and preferably is one or more of the following products:

1. A salt of the formula:

$$A1_n\,(OH)_m C1_{3n-m} \qquad (I)$$

in which m and n are positive integers and 3n-m is positive; such salt may contain a polyvalent anion Y selected from among the anions of sulfuric, phosphoric, polyphosphoric, silicic, chromic, carboxylic, and sulfonic acids, the molar ratio Y/A1 ranging from 0.015 to 0.4;

2. A salt of the formula:

$$A1_n(OH)_m C1_{3n-m-2k}(SO_4)k \qquad (II)$$

in which k, m and n are positive integers and 3n>m+ 2k, the basicity m/3n ranges from 0.3 to 0.7 and k/n ranges from 0.01 to 0.03; such a salt can be prepared according to the process described in U.S. Pat. No. 3,929,666;

3. A salt of the formula:

$$[A1_n(OH)_{3n-m-2p} C1_m(SO_4)_p]z \qquad (III)$$

in which (3n-m-2p)/3n ranges from 0.4 to 0.7; p ranges from 0.04 to 0.25n; m/p ranges from 8 to 35, k, m, n, and p are integers and z is at least 1; such a salt is described in GB-A-2,128,977;

4. A chlorosulfate of basic aluminum of the formula:

$$A1_n OH_m(SO_4)_k C1_{3n-m-2k} \qquad (IV)$$

in which the basicity (m/3n) 100 ranges from about 40% to about 65% and has an A1 equivalent/C1 equivalent ratio ranging from 2.8 to 5, an apparent molecular weight MA measured by conventional light diffusion and apparent hydrodynamic diameters ØZ and ØW measured by quasi-elastic light diffusion as follows:

MA=7,000–35,000

ØZ(Å)=350–2,500

ØW(Å)=200–1,200 this salt being described in FR-A-2,584,699.

Preferably, the PAC is present in the fibrous composition introduced into the headbox in an amount of 0.01% to 0.3% by weight, based on the weight of said fibrous composition, said percentage being expressed on the basis of $Al_2O_3$. Preferably, the PAC is WAC of formula IV.

The anionic silica, indicated as component (c)(3) according to the present invention, is one or more silicas selected from among silica sol, silica gel, microparticulate silica, silico-aluminate, bentone and bentonite. Preferably, the silica is present in the fibrous composition in an amount of 0.01% to 0.3% by weight, based on the weight of said fibrous composition, the percentage being expressed as a percentage of active constituent, in other words in $SiO_2$. Such silica of anionic nature preferably is in sol form, advantageously comprising 15% $SiO_2$.

The inorganic or mineral filler material, the component (a) indicated above, can be one or more of the conventionally employed fillers, such as the following, provided by way of example: clay, $CaCO_3$, hydrated alumina, talc, $TiO_2$, and the like. The inorganic filler represents less than 40% by weight, preferably 10% to 25% by weight, based on the weight of said fibrous composition. The preferred inorganic filler material is $CaCO_3$.

The sizing agent, the component (b) indicated above, can be one or more of the following conventional fillers employed for a neutral medium: alkyl ketene dimers (AKD), fluorinated phosphates, carboxylic acid anhydrides, styrene/maleic anhydride copolymers, and derivatives thereof. The amount of sizing agent employed is advantageously less than 10% by weight, preferably ranging from 0.01% to 2% by weight of the commercial product having 6% of active material, based on the weight of said composition. The preferred sizing agent is AKD.

The components (a), (b), (c)(1), (c)(2) and (c)(3) indicated above can be added separately, or in the form of a mixture of two or more thereof.

The fibrous suspension can also contain conventional additives such as coloring agents, optical brighteners, mechanical strengthening agents, anti-foaming agents, anti-slime agents, as well as products selected from among the polyacrylamides, polyethylene imines, carboxymethyl cellulose, urea/formol resins, melamine/formol resins, aminopolyamide/epichlorhydrin resins, polyamide/epichlorhydrin.

Preferably, the components added are:

(a) from 5% to 30% of $CaCO_3$, (b) from 0.01% to 1% of AKD, and (c) (1) from 0.2% to 1.7% of a cationic starch of molecular weight $2.10^4$ to $12.10^5$ and a degree of substitution of from 0.01 to 0.1;

(c) (2) from 0.1% to 3% of WAC as 10% $Al_2O_3$ commercial product; and (c)(3) from 0.01% to 0.3% of silica sol, expressed as % of $SiO_2$.

In order to further illustrate the present invention and the advantages thereof, the following specific examples are given, it being understood that same are intended only as illustrative and in nowise limitative.

In said examples to follow, WAC was a product marketed by Atochem and was a polyaluminum chloride of formula IV with 10% of $Al_2O_3$. The silica was in the form of a silica sol and is available commercially under the trademark CECASOL from Ceca. The cationic starch was manufactured by Roquette and marketed under the trademark HICAT 142. The AKD sizing agent was manufactured by Hercules and marketed under the trademark AQUAPEL.

EXAMPLE 1:

The paper manufactured was paper for printing or writing, suitable for carbonless copying paper.

| | | |
|---|---|---|
| (i) | Machine employed | flat bed fitted with a Bel Bond former, |
| (ii) | Speed | 590 m/min, |
| (iii) | Width | 3 m, |
| (iv) | Weight | 50 g/m$^2$ |
| Fiber composition: | | |
| (1) | Resinous bleached kraft pulp | 45% |
| (2) | Foliaceous bleached kraft pulp | 55% |
| (3) | Filler | $CaCO_3$ |
| (4) | Amount of filler in finished paper | 14% |
| (5) | Sizing (AKD) | 0.15% |
| (6) | Cationic starch | 0.6% |

The tests carried out on the product obtained, under the conditions reported in the Table I below, provided the results indicated in said Table:

TABLE I

| | | | Total | |
|---|---|---|---|---|
| | WAC | Silica (1) | Retention | Look-thru (2) |
| Test 1 | 0 | 0.5% | 58% | 104 |
| Test 2 | 1.65% | 0 | 57% | 70 |
| Test 3 | 1.65% | 0.15% | 67% | 72 |

(1) In commercial product, 15% active material.
(2) The look-thru was continuously measured using apparatus from the "Centre technique du papier" of Grenoble (France).

Comparing Test 1 and Test 2, the very significant improvement in look-thru obtained by the use of WAC instead of silica was apparent, contrary to that which would have been expected by one skilled in this art.

Test 3 illustrates the synergy provided by the association of small amounts of silica in the presence of WAC. For equivalent look-thru, retention was increased by 10 points, equivalent to an increase of 15% to 20%. This results in reduced water pollution from the circuits and greater ease of treating waste water at a reduced cost.

EXAMPLE 2

The paper manufactured was a paper for printing and writing. The machine was identical to that of Example 1.

| | | |
|---|---|---|
| (i) | Machine speed | 540 m/min, |
| (ii) | Paper Weight | 60 g/m$^2$ |
| Fiber composition: | | |
| (1) | Resinous bleached kraft pulp | 40% |
| (2) | Foliaceous bleached kraft pulp | 60% |
| (3) | Filler | $CaCO_3$ |
| (4) | Amount of filler in finished paper | 11% |
| (5) | Sizing (AKD) (in commercial product) | 0.15% |
| (6) | Cationic starch | 0.5% |

The tests carried out on the product obtained, under the conditions reported in the Table II below, provided the results indicated in said Table:

TABLE II

| | | | Total | | |
|---|---|---|---|---|---|
| | WAC | Silica | Retention | Look-thru | HBC (1) |
| Test 1 | 1.6% | 0 | 60% | 76 | 8.4 g/l |
| Test 2 | 1.5% | 0.15% | 73% | 75 | 6.5 g/l |

(1) HBC = headbox concentration

EXAMPLE 3:

The same machine was used as in Example 2.

| | | |
|---|---|---|
| (i) | Machine speed | 520 m/min, |
| (ii) | Paper Weight | 70 g/m$^2$ |
| Fiber composition: | | |
| (1) | Resinous bleached kraft pulp | 35% |
| (2) | Foliaceous bleached kraft pulp | 65% |
| (3) | Filler | $CaCO_3$ |
| (4) | Amount of filler in finished paper | 14% |
| (5) | Sizing (AKD) (in commercial product) | 0.15% |
| (6) | Cationic starch | 0.6% |

The tests carried out on the product obtained, under the conditions reported in Table III below, provided the results indicated in said Table:

TABLE III

| | | | Total | | |
|---|---|---|---|---|---|
| | WAC | Silica | Retention | Look-thru | HBC |
| Test 1 | 1.5% | 0 | 67% | 75 | 8.7 g/l |
| Test 2 | 1.5% | 0.25% | 78% | 76 | 7.2 g/l |

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. An aqueous suspension of a papermaking composition comprising cellulosic papermaking fibers and based on total weight of said composition:

(a) from 5 to 30% of $CaCO_3$ filler;

(b) from 0.01 to 2% of alkyl ketene dimer as a paper sizing agent;

(c)(1) from 0.2 to 1.7% of a cationic starch having a molecular weight ranging from $3\times10^4$ to $12\times10^4$ and a degree of substitution ranging from 0.01 to 0.1;

(c)(2) from 0.01 to 0.3% of a polyaluminum chloride, expressed as $Al_2O_3$, said polyaluminum chloride comprising a salt having the formula:

$$Al_nOH_m(SO_4)_kCl_{3n-m-2k}$$

in which the basicity (m/3n) ranges from about 0.4 to 0.65 and which has an Al equivalent/Cl equivalent ratio ranging from 2.8 to 5, an apparent molecular weight MA measured by conventional light diffusion and apparent hydrodynamic diameters ØZ and ØW measured by quasi-elastic light diffusion as follows:

MA=7,000–35,000

ØZ(Å)=350–2,500

ØW(Å)=200–1,200; and (c)(3) 0.01 to 0.3% of an anionic silica sol, expressed as $SiO_2$.

2. The papermaking composition of claim 1, further comprising a polyethyleneimine, carboxymethyl cellulose, urea/formol resin, melamine/formol resin, aminopolyamide/epichlorhydrin resin, polyamide/epichlorhydrin resin, or a mixture thereof.

3. A papermaking process comprising dewatering and forming a paper web from an aqueous suspension of a papermaking composition, said papermaking composition comprising cellulosic papermaking fibers and based on the total weight of the composition:

(a) from 5 to 30% of an $CaCO_3$ filler;

(b) from 0.01 to 2% of alkyl ketene dimer as a paper sizing agent;

(c)(1) from 0.2 to 1.7% of a cationic starch having a molecular weight ranging from $3\times10^4$ to $12\times10^4$ and a degree of substitution ranging from 0.01 to 0.1;

(c)(2) from 0.01 to 0.3% of a polyaluminum chloride, expressed as $Al_2O_3$, said polyaluminum chloride comprising a salt having the formula:

$$Al_nOH_m(SO_4)_kCl_{3n-m-2k}$$

in which the basicity (m/3n) ranges from about 0.4 to 0.65 and which has an Al equivalent/Cl equivalent ratio ranging from 2.8 to 5, an apparent molecular weight MA measured by conventional light diffusion and apparent hydrodynamic diameters ØZ and ØW measured by quasi-elastic light diffusion as follows:

MA=7,000–35,000

ØZ(Å)=350–2,500

ØW(Å)=200–1,200; and (c) (3) 0.01 to 0.3% of an anionic silica sol, expressed as $SiO_2$.

4. A homogeneous paper product of the process as defined by claim 3.

* * * * *